US008939087B2

(12) United States Patent
McKisic et al.

(10) Patent No.: US 8,939,087 B2
(45) **Date of Patent: *Jan. 27, 2015**

(54) MODULAR BASE SIDE BEARING

(71) Applicant: A. Stucki Co., Moon Township, PA (US)

(72) Inventors: Aubra D. McKisic, Baden, PA (US); John G. Faryniak, Pittsburgh, PA (US)

(73) Assignee: A. Stucki Co., Moon Township, PA (US)

( * ) Notice: Subject to any disclaimer, the term of this patent is extended or adjusted under 35 U.S.C. 154(b) by 70 days.

This patent is subject to a terminal disclaimer.

(21) Appl. No.: 13/758,292

(22) Filed: Feb. 4, 2013

(65) Prior Publication Data

US 2013/0142464 A1 Jun. 6, 2013

Related U.S. Application Data

(63) Continuation of application No. 10/939,667, filed on Sep. 13, 2004, now Pat. No. 8,534,202.

(60) Provisional application No. 60/513,658, filed on Oct. 23, 2003.

(51) Int. Cl.

| | |
|---|---|
| ***B61F 3/00*** | (2006.01) |
| ***B61F 15/20*** | (2006.01) |
| ***B61F 5/14*** | (2006.01) |

(52) U.S. Cl.

CPC .. *B61F 15/20* (2013.01); *B61F 5/14* (2013.01)
USPC ..... 105/199.3

(58) Field of Classification Search

USPC ..... 105/199.1, 199.3, 453; 384/423, 595
See application file for complete search history.

(56) References Cited

U.S. PATENT DOCUMENTS

| | | | | |
|---|---|---|---|---|
| 979,120 | A | | 12/1910 | Woods |
| 1,728,336 | A | | 9/1929 | Downey |
| 2,394,158 | A | | 2/1946 | Ellis et al. |
| 2,647,449 | A | | 4/1954 | Tucker |
| 2,821,380 | A | | 1/1958 | Strandberg |
| 3,295,463 | A | | 1/1967 | Barber |
| 3,401,991 | A | | 9/1968 | MacDonnell |
| 3,748,001 | A | * | 7/1973 | Neumann et al. ..... 384/423 |
| 3,957,318 | A | | 5/1976 | Wiebe |
| 4,080,016 | A | | 3/1978 | Wiebe |
| 4,245,564 | A | | 1/1981 | Eulenfeld |
| 4,323,015 | A | | 4/1982 | Hess et al. |
| 4,408,810 | A | | 10/1983 | Geyer |
| 4,712,487 | A | | 12/1987 | Carlson |
| 4,859,089 | A | | 8/1989 | Wright |
| 4,998,997 | A | | 3/1991 | Carlson |

(Continued)

*Primary Examiner* — Robert J. McCarry, Jr.
(74) *Attorney, Agent, or Firm* — Buchanan Ingersoll & Rooney PC

(57) ABSTRACT

A modular base side bearing assembly has a cage with upstanding side walls defining a bearing cavity and a central bottom opening to receive a modular base on which a bearing element supported on a central base portion thereof. The modular base has externally visible tabs identifying a force level corresponding to the modular base, in which the thickness of the central base portion corresponds such force level. The modular bases are interchangeable with modular bases having central base portions of differing thickness, or zero-thickness, such that the same cage, bearing element, and wear cap can be used with different modular bases to provide different force levels. The modular base is movable vertically relative to the cage to accommodate uneven mounting surfaces.

34 Claims, 7 Drawing Sheets

(56) References Cited

U.S. PATENT DOCUMENTS

| | | | | |
|---|---|---|---|---|
| 5,207,161 | A | 5/1993 | Pileggi et al. | |
| 5,386,783 | A | 2/1995 | Rhen et al. | |
| 5,401,008 | A | 3/1995 | Winkler et al. | |
| 5,451,110 | A | 9/1995 | Gams, Jr. et al. | |
| 5,454,330 | A | 10/1995 | Rhen | |
| 5,601,031 | A | 2/1997 | Carlson | |
| 5,682,822 | A * | 11/1997 | Sunderman et al. | 105/199.3 |
| 6,092,470 | A | 7/2000 | O'Donnell | |
| 6,581,527 | B2 | 6/2003 | Hewitt | |
| 6,708,624 | B2 | 3/2004 | Faryniak et al. | |
| 2005/0087092 | A1 * | 4/2005 | McKisic et al. | 105/199.3 |

* cited by examiner

MODULAR BASE SIDE BEARING

CROSS REFERENCE TO RELATED APPLICATION

This application claims priority from U.S. Provisional Patent Application Ser. No. 60/513,658, filed Oct. 23, 2003.

BACKGROUND

In a railway freight car composed of a carbody supported by truck assemblies, side bearing assemblies on each side of the centerline of each truck bolster allow a portion of the carbody weight to be transmitted to the truck bolster at a position laterally outboard of the centerplate when the carbody leans with respect to the truck due to track irregularities, track crosslevel, or centrifugal force. A constant-contact side bearing, hereinafter referred to as a CCSB, includes a loading means to effect a supporting load at such a side bearing when the carbody has not leaned relative to the truck bolster.

In a CCSB, between the normal setup height and the solid stop height, where further leaning of the carbody is resisted by a sharply increased force, the force borne by the side bearing generally increases with increased compression of the side bearing assembly. This force is typically provided by one or more spring elements. These spring elements may be mechanical springs or elastomeric springs. At the solid stop height, another load path through very stiff elements prevents damage to the spring element. There are numerous examples in the industry, and this is well known to those skilled in the art.

A primary purpose of a CCSB is to provide a controlled resistance to truck swivel. When choosing the force which the side bearing design is to provide at the normal setup height, the carbody suspension designer must balance the need for truck hunting control at high speeds with the need for satisfactory curving behavior, especially when the car is in an unloaded condition. Normally, a higher side bearing force produces a more stable condition of the car during travel at high speed. However, if the force is too high, the increased resistance may inhibit the ability of the truck to swivel easily enough to negotiate curves, resulting in at least unnecessary wheel wear and at worst a disastrous derailment.

Association of American Railroads (AAR) standards require that the car design exhibit good stability at speeds up to 70 mph. For curve negotiation, the AAR requires that the normal setup height force be limited to no more than a value predicted by the result of a calculation found in Part B of Specification M-948 of the Manual of Standards and Recommended Practices. This calculation is specific to the car design and requires knowledge concerning the unloaded carbody weight, the distance between truck axles (wheelbase), and the restraint likely to be provided by the centerplate. Typical nominal setup height forces for different models vary between 2200 and 6000 pounds. The AAR Specification M-948 also states that the components which determine the force must have a non-interchangeability feature to prevent the inadvertent assembly of a spring element of a higher force into an assembly intended for a lower design force.

Industry requirements also dictate that the CCSB designs incorporate a method for permanently marking designs of differing forces in such a way that those persons responsible for installing the side bearing may visually determine that the correct model is being used. Additionally, maintenance personnel need to be able to see the model designation while the side bearing is assembled on the car, both to verify that the correct design is applied and, if the spring element is to be replaced, to determine whether or not the necessary replacement parts are available before the side bearing is disassembled.

CCSBs typically have a cage member attached to the truck bolster and a cap member in contact with a wear plate attached to the carbody bolster. The force of the side bearing is provided by a spring element reacting between the cage and the cap. The side bearing force is dependent upon the compression characteristics of the spring element and the design of the cage and cap. The space between truck bolster and carbody side bearing wearplate determines the normal setup height, and is achieved by shimming, ordinarily between the carbody side bearing wearplate and the carbody bolster. In order to meet the AAR requirements for marking, the model designation and nominal force at normal setup height is usually stamped or cast into the cage and/or cap members so as to be visible both before and after assembly onto the car. The non-interchangeability requirement is achieved by including physical features which assure incompatibility of the cage, cap, and spring components.

Some designs have provided for the use of a single spring element for more than one model. In this case, the basic design of the side bearing body or cap may be modified so that the compression of the spring is different for different models. This is a convenience for the user, for only one kind of spring element must be stocked to maintain several models of side bearing. A common method for executing this design is by casting or machining the floor of the cage member to different heights for different models. In this way, the appropriate force for each model is achieved by the appropriate compression at normal setup height. Examples of this method are A. Stucki Company's Compact Column Bearing™, CSB® and SSB® designs. In this case, the appropriate model designation or setup force must be cast or stamped into the member which has been chosen to be produced with variable geometry.

AAR Specifications also require bolsters to maintain a certain flatness in the area of side bearing attachment. In some cases this is requirement is not met. Particularly, the bolster mounting surface can have a "high spot," e.g., the mounting surface under the center of the cage is higher than the "ears" (the bolt flanges on either side of the cage). Thus, when the side bearing assembly is bolted to the bolster, the cage can experience detrimental stresses and deformations that can inhibit the performance of the unit, or even result in structural failure.

In view of the above, it would be desirable make CCSBs wherein the side bearing force level could be changed, but the same cage, wear cap, and bearing element could be used. In this way, a significant cost savings can be accomplished simply by not having to make a dedicated cage for each different force level side bearing that is needed. Additionally, the CCSB could be designed to prevent the possibility of incorrect assembly while also displaying accurate model numbers or force levels in a readable manner for easy reference. It will also be desirable to provide a CCSB design that is more tolerant to non-flat bolster mounting surfaces.

SUMMARY OF THE INVENTION

According to the invention, a modular base side bearing assembly can be provided having a cage portion defining a bearing cavity with a bearing element disposed therein and a wear cap disposed over the bearing element. The cage is provided with a central bottom opening for receiving an interchangeable modular base, upon which the bearing element is supported. The modular base has identification portions which extend from, or are at least plainly visible externally of, the cage when the modular base is assembled with the cage. The modular base is designed to be received in the central bottom opening in cage, with the aforesaid identification portions being visible externally of the cage when the two are assembled together. The identification portions can be marked, or configured, in various ways to identify, for example, a specific force level corresponding to a specific modular base. Different modular bases can have different degrees of thickness at the central portion on which the bearing element is supported. Alternatively, in some embodiments, the modular base may, like the bottom of the cage, have a central opening, i.e., "zero," such that the bearing element is supported on the same surface to which the cage is mounted. In this manner, the height at which the bearing element is supported, which corresponds to different force levels, can be changed using different modular bases, such that different modular bases can be interchanged with the same cage, bearing element and wear cap. Accordingly, different modular bases can be utilized to provide side bearing assemblies of different force levels without having a dedicated cage for each force level, as is conventionally required to provide side bearings with different force levels.

The modular base is assembled with the cage in a manner to provide a degree of vertical play relative to the cage such that an uneven bolster mounting surface is accommodated without stressing or distorting the cage when the ears are bolted down. For example, the body of the modular base can be fitted into the central bottom opening in the cage in a manner to accommodate non-flat, uneven mounting surfaces. In particular, the modular base can be held in the central bottom opening in a manner to prevent complete detachment, but with enough play in the vertical direction relative to the cage so that the modular base can accept, for example, a high spot in the mounting surface. In this way, the cage will not be distressed when the ears are bolted to the bolster mounting surface.

According to the invention, the cage need not be marked with a specific force level, or other indication thereof. Instead, the force level will be associated with, and identified on, a particular modular base which is used with the cage. In this way, the cage, bearing element, and wear cap can be common to all models, i.e., utilized with different modular bases. The assembly of more than one model, or force level, is produced by the selection of one of a variety of modular bases having different degrees thickness, including zero thickness, which correspond to, and are clearly marked with, different force levels for the side bearing when the specific modular base is assembled therewith. Each modular base has identification portions by which the appropriate model or force information can be positively identified. The shape of the cage and the modular base cooperate so that when the cage is attached to the truck bolster, the modular base cannot be changed and the identification portions of the modular base are plainly visible.

The only variation between different models of side bearing assemblies is the modular base, which identifies the model. Consequently, there can be no case in which the inadvertent selection of a wrong component results in a side bearing with force characteristics different from those indicated by the side bearing assembly once the modular base is assembled therewith.

DETAILED DESCRIPTION OF CERTAIN EMBODIMENTS

Figure 1:
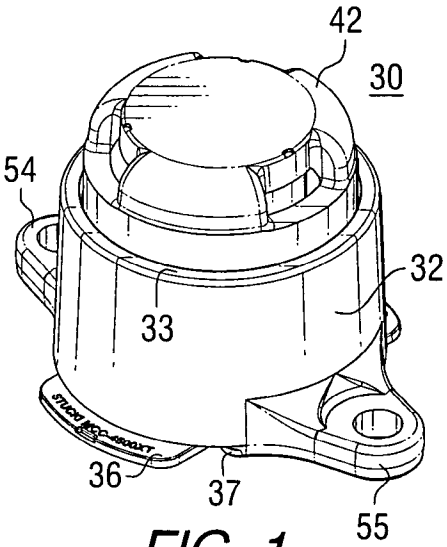
FIG. 1 is a isometric view of an embodiment of a modular base side bearing assembly according to the invention.
Figure 2:
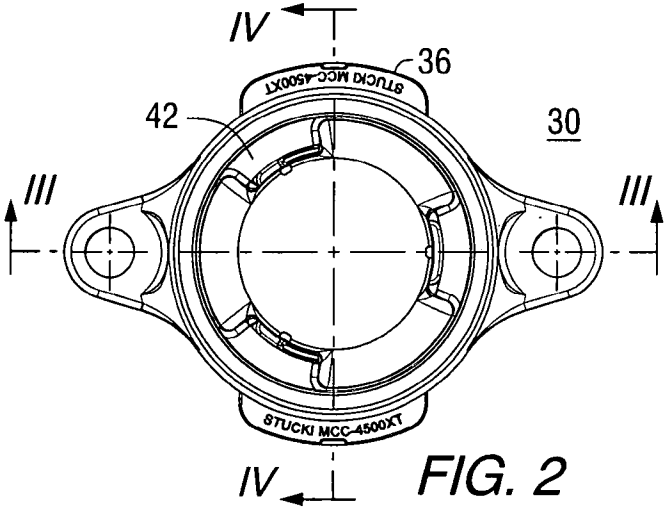
FIG. 2 is a top view of the modular base side bearing assembly shown in FIG. 1.
Figure 4:
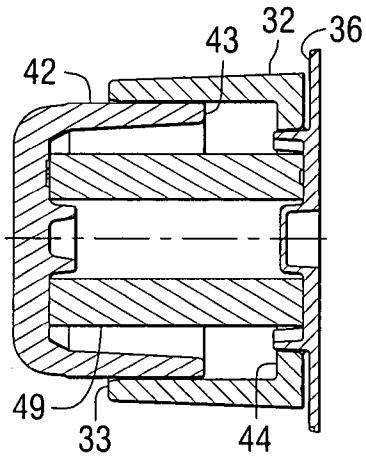
FIG. 4 is a section view taken along the line IV-IV in FIG. 2.
Figure 3:
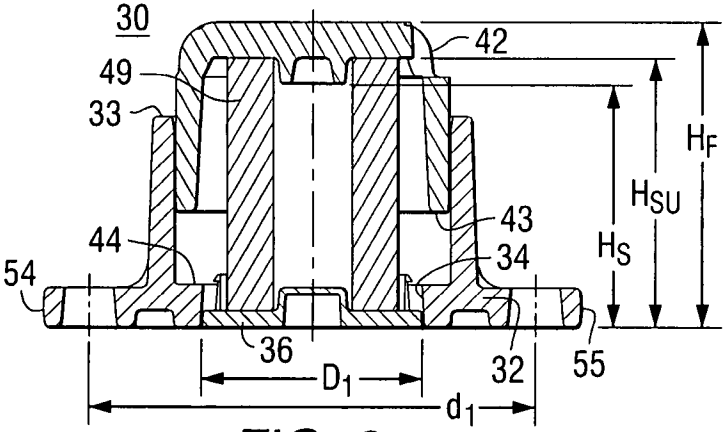
FIG. 3 is a section view taken along the line III-III in FIG. 2.
Figure 5:
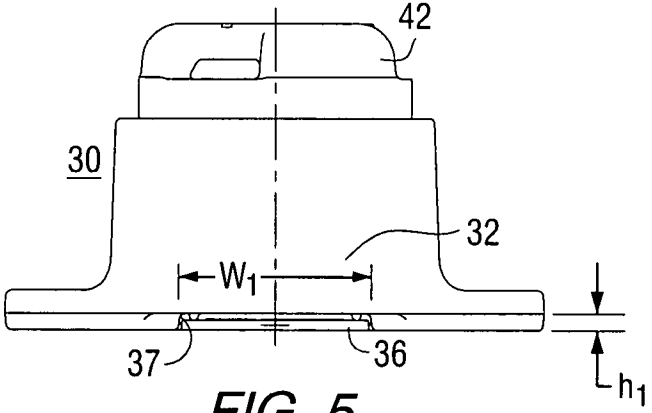
FIG. 5 is a side view of the modular base side bearing assembly shown in FIG. 1.

Referring now to the drawing figures, there is shown in FIGS. 1 through 5 an embodiment of a modular base side bearing assembly 30 according to the invention. The modular base side bearing assembly can include a cage 32 having upstanding side walls 33 defining a bearing cavity sized to receive a resilient bearing element 49. The cage 32 can have a central bottom opening 34 such that the bearing element 49 is not supported by the bottom of the cage. Instead, the cage 32 is configured to receive a modular base 36, which defines the bottom surface of the bearing cavity, and the height at which the bearing element 49 is supported in the bearing cavity.

As illustrated, the upstanding side walls 33 form a generally cylindrical bearing cavity in which is disposed the bearing element 49 and, in the embodiment shown, a wear cap 42, which fits over the bearing element 49, and has downwardly depending side walls 43 that slide within the generally cylindrical bearing cavity formed by the cage 32. The central bottom opening 34 in the cage 32 can have a larger diameter than the bearing element 49, but can have a smaller diameter than the wear cap 42, such that a solid stop is provided by an shelf 44 formed by the central bottom opening 34 which cooperates with a skirt portion 43 of the wear cap 42 to limit the downward travel of the wear cap 42. As shown, the cage 32 also has ears, e.g., bolt flanges 54, 55, at opposite side thereof for fastening the cage 32 to a bolster mounting surface (not shown).

Although the various embodiments of modular base side bearing assemblies illustrated in the drawing figures all have a generally cylindrical bearing cavity in which is disposed a generally cylindrical bearing element, and a generally cylindrical wear cap, it is to be understood that a modular base side bearing assembly could also be formed in, for example, square, rectangular, and other shapes.

In a presently preferred embodiment, the modular base side bearing assembly 30 with modular base 36 can have a free height $H_f$ of about 5 13/16 inches, will go solid at a height $H_s$ of about 4 7/16 inches, and has a nominal set up height $H_{su}$ of about 5 1/16 inches. The tolerances for $H_s$ and $H_{su}$ can be ±1/16 inch.

Figure 6:
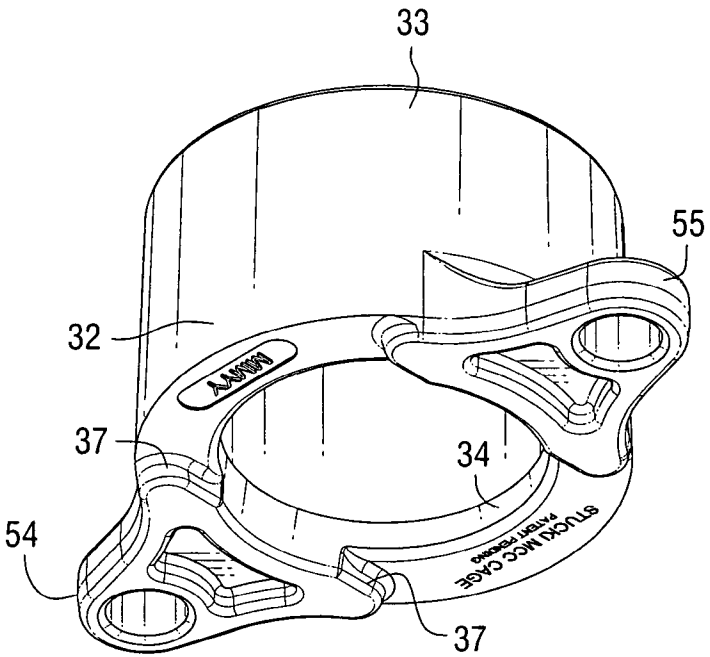
FIG. 6 is isometric view showing the underside of an embodiment of a cage member according to the invention.
Figure 7:
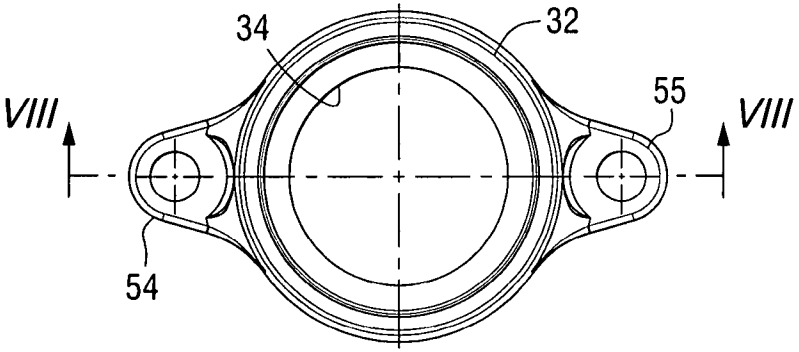
FIG. 7 is a top view of the cage shown in FIG. 6.
Figure 8:
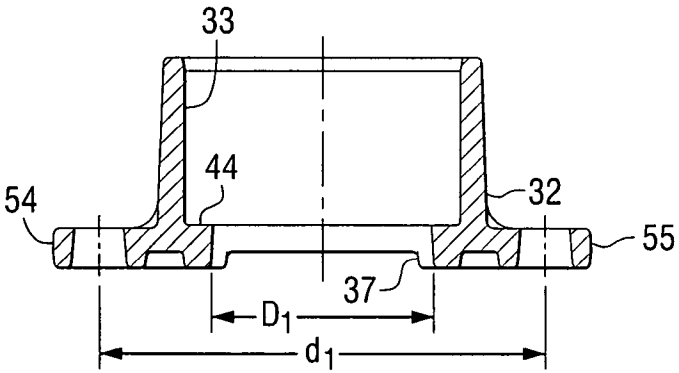
FIG. 8 is section view taken line VIII-VIII in FIG. 7.
Figure 13:
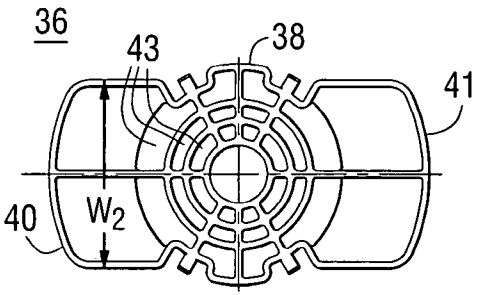
FIG. 13 is a bottom view taken from line XIII-XIII in FIG. 11.
Figure 9:
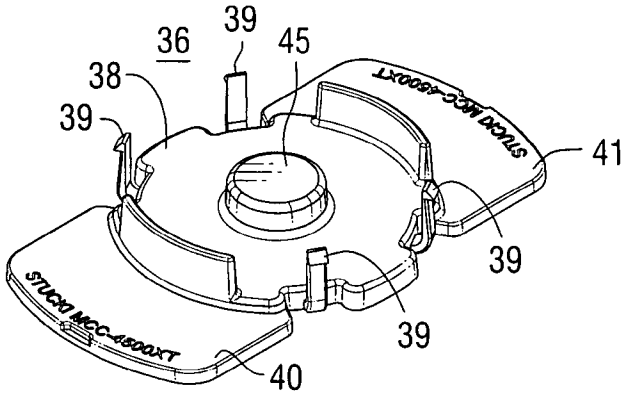
FIG. 9 is a isometric view of an embodiment of a modular base according to the invention.
Figure 12:
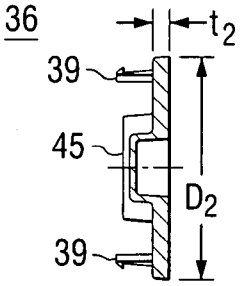
FIG. 12 is a section view taken through line XII-XII in FIG. 10.
Figure 10:
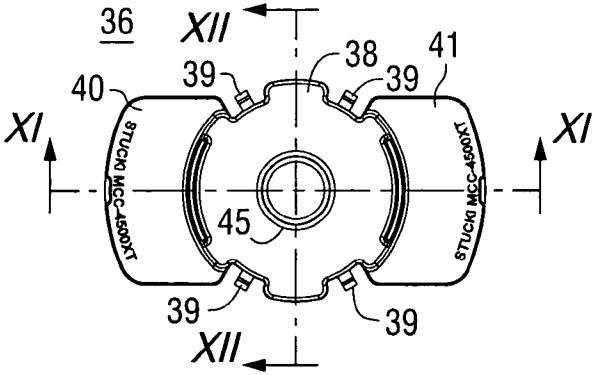
FIG. 10 is a top view of the modular base shown in FIG. 9.
Figure 11:
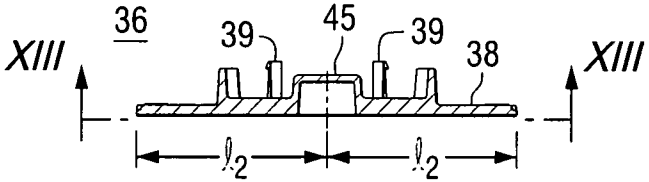
FIG. 11 is a section view taken through line XI-XI in FIG. 10.
Figure 18:
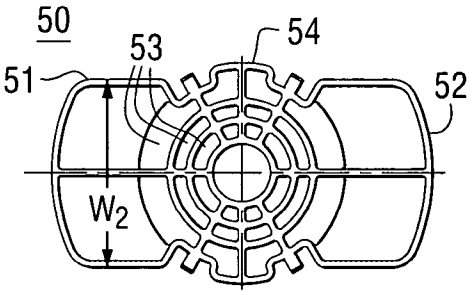
FIG. 18 is a bottom view taken from line XVIII-XVIII in FIG. 16.
Figure 14:
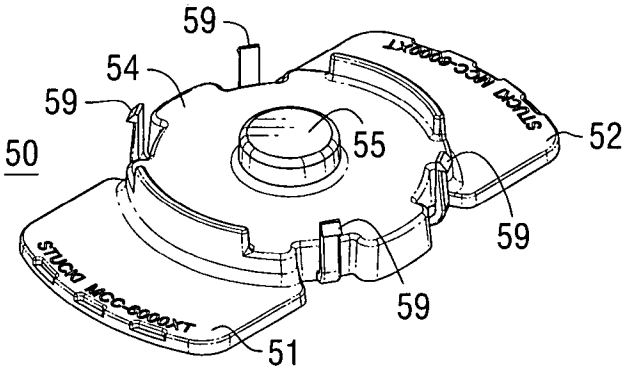
FIG. 14 is a isometric view of another embodiment of a modular base according to the invention.
Figure 17:
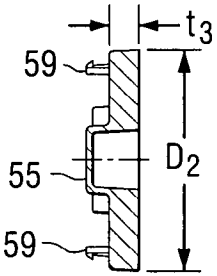
FIG. 17 is a section view taken along line XVII-XVII in FIG. 15.
Figure 15:
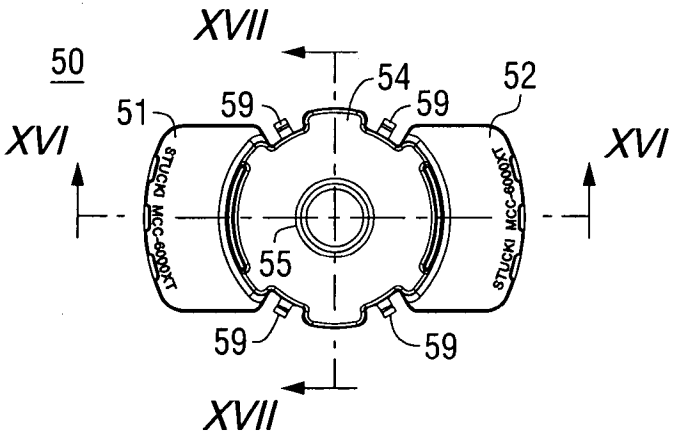
FIG. 15 is top view of the modular base shown in FIG. 14.
Figure 16:
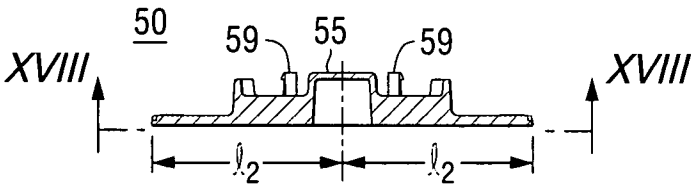
FIG. 16 is a section view taken along line XVI-XVI in FIG. 15.
Figure 22:
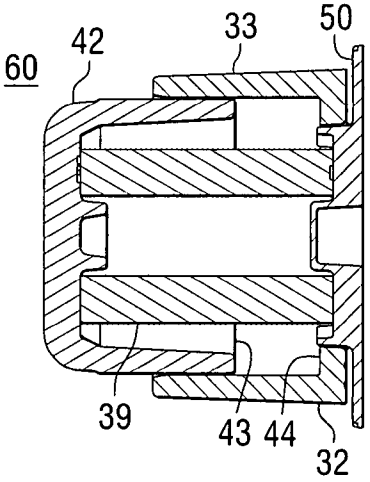
FIG. 22 is a section view taken along line XXII-XXII in FIG. 20.
Figure 19:
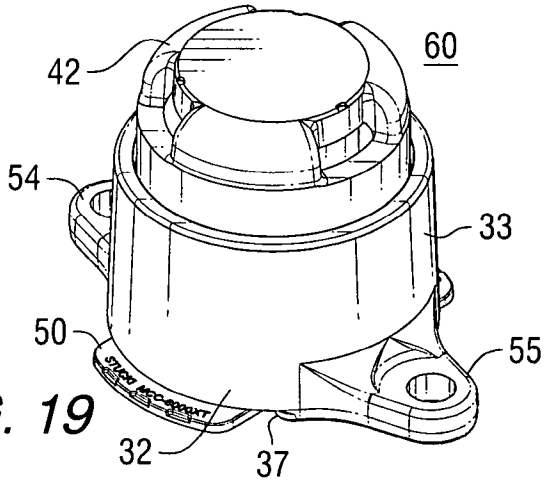
FIG. 19 is a isometric view of another embodiment of a side bearing assembly such as shown in FIG. 1.
Figure 20:
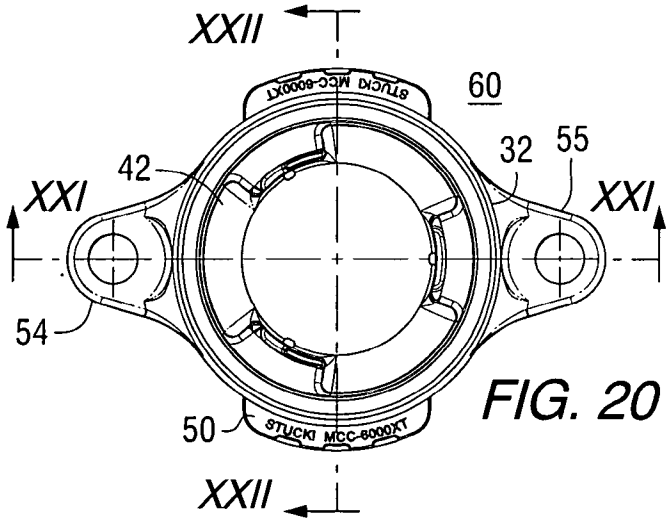
FIG. 20 is a top view of the modular base side bearing assembly shown in FIG. 19.
Figure 21:
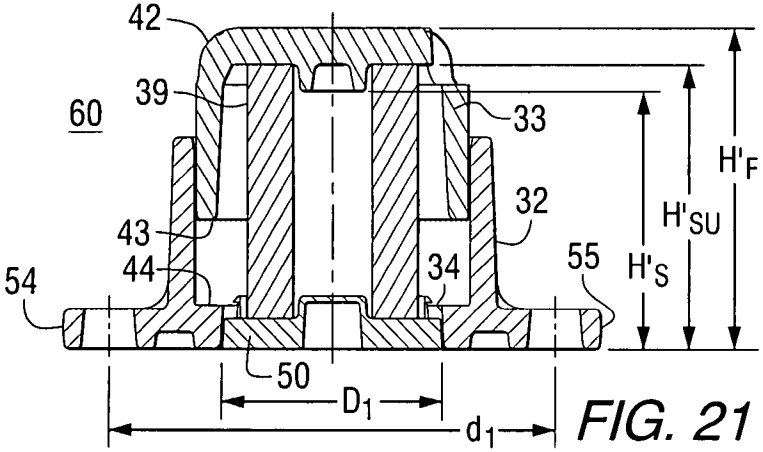
FIG. 21 is a section view taken along line XXI-XXI in FIG. 20.
Figure 27:
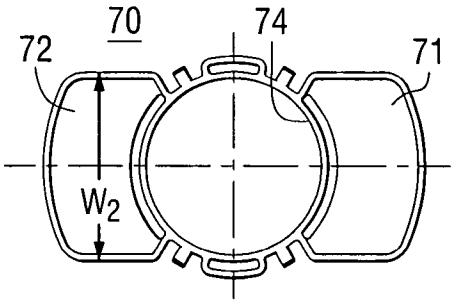
FIG. 27 is a bottom view taken from line XXVII-XXVII in FIG. 25.
Figure 26:
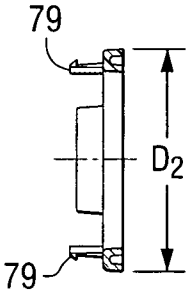
FIG. 26 is a section view taken along line XXVI-XXVI in FIG. 24.
Figure 23:
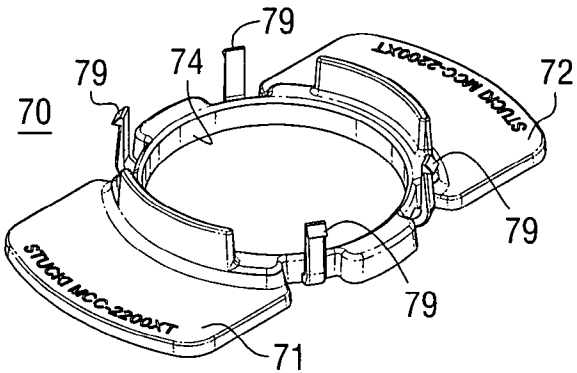
FIG. 23 is a isometric view of another embodiment of a modular base according to the invention.
Figure 24:
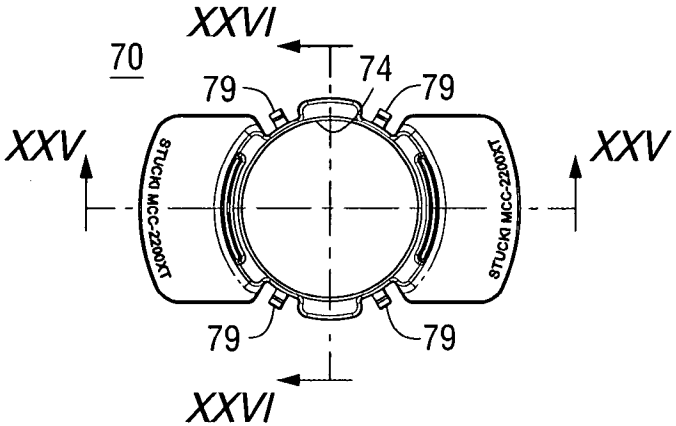
FIG. 24 is top view of the modular base shown in FIG. 23.
Figure 25:
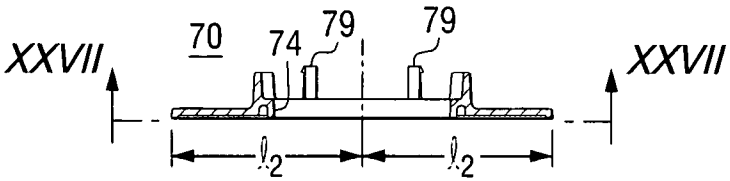
FIG. 25 is a section view taken along line XXV-XXV in FIG. 24.
Figure 31:
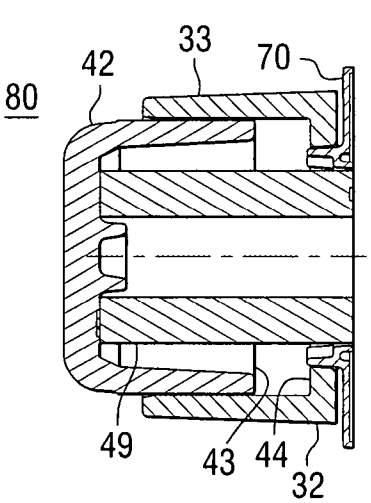
FIG. 31 is a section view taken along line XXXI-XXXI in FIG. 29.
Figure 29:
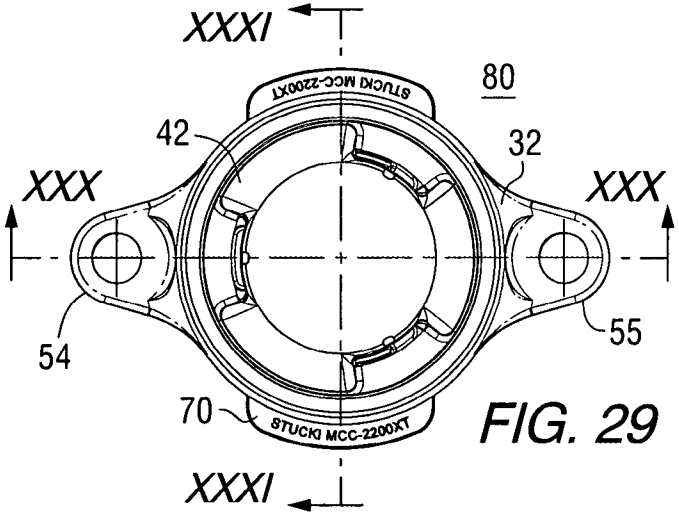
FIG. 29 is a top view of the modular base side bearing assembly shown in FIG. 28.
Figure 28:
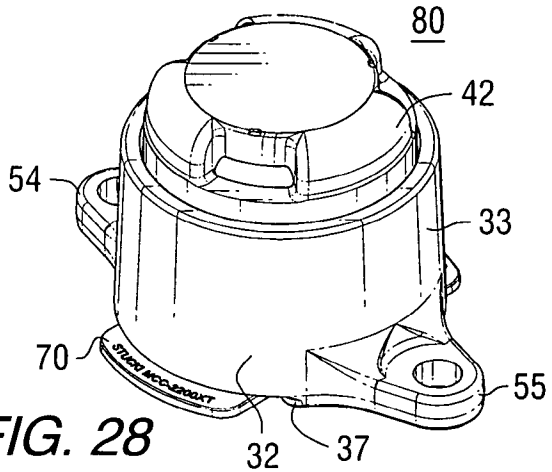
FIG. 28 is a isometric view of another embodiment of a side bearing assembly such as shown in FIG. 1.
Figure 30:
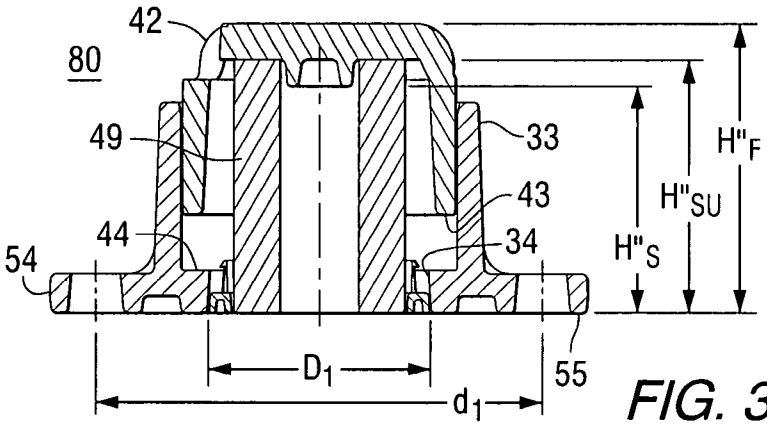
FIG. 30 is a section view taken along line XXX-XXX in FIG. 29.

FIGS. 6 through 8 illustrate an embodiment of the cage 32, which is designed to be essentially a generic part of the side bearing assembly for use with different modular base members, such as the modular base 36 shown in FIGS. 9 through 13, for example. In particular, the bottom of the cage 32, including the central bottom opening 34, is designed to receive the modular base 36. The central bottom opening 34 can have the same dimension regardless of the modular base which is used with the cage 32, and the bearing cavity formed by the upstanding side walls 33 can also be the same size. In this manner, the same cage 32, bearing element 49, and wear cap 42 can be utilized with any modular base member that is assembled with the cage 32.

In a preferred embodiment, the central bottom opening 34 in the base of the cage 32, in which is received the modular base 36, can have a diameter ($D_1$) of about 4 1/4 inches, ±1/32 of an inch, to provide a limited degree of play so that the modular base 36 can move vertically to some degree (as will be described in more detail hereinafter).

To permit the tabs 40, 41 to be visible externally of the cage 32, openings 37 can be provided, for example, through, or in, the bottom surface of the cage 32 which extend to the outside of the cage 32. As shown, a pair of openings 37 can be provided, one for each tab 40, 41, at opposite sides of the cage 32, through which the tabs 40, 41 project so as to be visible externally of the cage 32. The openings 37 can be formed as a recessed portion of the bottom surface of the cage 32, and can communicate with the central bottom opening 34. In a preferred embodiment, each opening 37 can each be about 5/16 inch in height ($h_1$) and about 3 5/8 inches in width ($w_1$). The ears 54, 55 of the cage can be about 27/32 inch thick ($t_1$), and the distance ($d_1$) between the centers of the mounting holes in each ear 54, 55 is about 8 1/2 inches.

FIGS. 9 through 13 illustrate an embodiment of the modular base 36 according to the invention. The modular base 36 has a central base portion 38 which forms a generally planar upper surface that defines the bottom of the bearing cavity, and supports the bottom of the bearing element 49 when the modular base 36 is assembled onto the bottom of the cage 32. The central base portion 38 has a shape corresponding to the shape of the central bottom opening 34 in the cage 32, in this case circular, in which it is receivable. Alternatively, the central bottom opening 34 and the central base portion 38 could have other shapes, for example, such as where rectangular cage side bearing assembly may be utilized.

The central base portion defines the bottom of the bearing cavity, and thus the thickness of the central base portion 38 defines the height at which the bearing element 49 is supported. The height at which the bearing element 49 is supported corresponds to the force level of the assembled side bearing. Consequently, the thickness of the central base portion 38 defines the force level for the assembled side bearing.

The modular base 36 also has identification portions, or tabs 40 and 41, described above, which project outward from, for example, opposite sides of, the central base portion 38. These tab portions 40, 41 are sized to extend through the openings 37 in the cage 32, such as at opposite sides of the cage 32, such that the tab portions 40, 41 are visible when the modular base 36 is assembled with the cage 32. On the tabs 40, 41 is provided information about the force level of the particular modular side bearing assembly with which the modular base 36 is assembled. Alternatively, the tabs may be configured, such as by providing notches, or indentations, which indicate a particular force level, such as according to the number of notches or indentations provided. Another alternative identification method is color coding, i.e., using different colors to indicate different force levels. In any event, the tap portions 40, 41 are visible and easily readable, even after the side bearing assembly 30 has been installed on a rail vehicle.

The tab portions 40, 41 could be configured to prevent removal of the modular base 36 from the cage 32 after assembly with the cage 32. However, according to preferred embodiments of the invention, upstanding clips 39 (four shown, for example) can be provided which snap onto the shelf 44, which is the travel limiting portion, of the central bottom opening 34 of the cage 32. The modular base 36 can further have an upstanding boss 45 in the center thereof for locating the bottom of the bearing element 49, which can include either a hole through the bearing element 49 or a blind hole in the bottom thereof. However, the more pertinent feature of the modular base 36 relates to the thickness of the central base portion 38 which supports the bearing element 49. The thickness of the central base portion controls the degree of pre-compression on the bearing element 49 when the modular base side bearing assembly 30 is installed. The bottom surface of the modular base 36 will be generally flush with the bottom surface of the cage 32, except for when accommodating an uneven mounting surface, as will be described in more detail hereinafter. Thus, when the modular side bearing assembly 30 is attached to the mounting surface, it is the thickness of the modular central base portion 38 which determines the force level for the modular base side bearing assembly 30. In this way, the force of the modular base side bearing assembly 30 can be changed simply by removing the modular base 36 and replacing it with another modular base which provides a different force level, corresponding to the thickness of the central base portion 38 of the substituted modular base that will form the new bottom of the cavity in the cage 32 on which the bearing element 49 is supported.

Alternatively, embodiments of a modular base, as will be described in more detail hereinafter, can be provided in which the central base portion has zero thickness, i.e., the central base portion is a central opening, and the bearing element 49 is supported on the same surface to which the cage 32 is mounted. The central opening could have side walls which are receivable in the central bottom opening 34 in the cage 32.

In a presently preferred embodiment, the central base portion 38 of the modular base 36 can be generally cylindrical, with an outside diameter ($D_2$) of about 4 3/16 inches and a can have an operating thickness ($t_2$) of about 5/16 inch on which the bearing element 49 is supported. Each identification portion 40, 41 can have a width ($w_2$) of about 3 9/16, inch and can extend radially outward ($l_2$) about 3 5/16 inches from the center of the central base portion 38.

An embodiment of another, interchangeable, modular base 50 is illustrated in FIGS. 14 through 18. The modular base 50 has a central base portion 54 and can be essentially identical to the modular base 36 in every respect except two: (1) the thickness of the central base portion 54; and (2) the identifying information on the tabs 51, 52, which corresponds to the specific force level provided by the modular base 50. As shown, the modular base 50 also has outward extending tabs 51, 52, like the tabs 40, 41 on the modular base 36, which protrude through the openings 37 in the bottom surface at opposite sides of the cage 32 when the modular base 50 is assembled therewith, upstanding boss 55 which centers the bearing element 49, and upstanding clips 59 which cooperate with the travel limiting stop 44 at the bottom of the cage 32.

FIGS. 19 through 22 illustrate another embodiment of a modular side bearing assembly 60 having the same cage 32, bearing element 49 and wear cap 42 as used in the modular side bearing assembly 30 illustrated in FIGS. 1 through 5. The only difference in the modular side bearing assembly 60 is that the modular base 50, shown in FIGS. 14 through 18, is assembled with the cage 32 instead of the modular base 36. The modular base 50 fits onto the bottom of the cage 32, with the central base portion 54 received in the central opening 34 in the bottom of the cage 32. The central base portion 54 of the modular base 50 is thicker than in the modular base 36, such that bearing element is supported at a greater height free from the from the mounting surface, resulting in a greater preload, and thus a greater force level for the side bearing assembly 60. The thickness of the tab portions 51, 52 can be the same as for the tab portions 41, 42 of the modular base 36. Thus, the tab portions 51, 52 similarly extend through the same sized openings 37 in the bottom surface at opposite sides of the cage 32. The tabs, i.e., identification portions, 51, 52, of the modular base 50 likewise prominently display, in some manner, the force level of the side bearing assembly which corresponds particularly to the modular base 50.

In a presently preferred embodiment, the central base portion 54 of the modular base 50 can also have an outside diameter ($D_2$) of about 4 3/16 inches, the same as the modular base 36, but can have an operating thickness ($t_3$) of about 9/16 inch where the bearing element 49 is supported thereon. Since this dimension is slightly thicker than the 5/16 inch thickness ($t_2$) of the modular base 36, the force level for the side bearing assembly with this modular base 50 will be higher than using the modular base 36 having a thinner central base portion 38. In other respects, the modular base 50 can be identical to the modular base 36, including the tabs 51, 52, having the same width ($w_2$) of about 3 9/16 inch and likewise extending radially outward the same distance ($l_2$) of about 3 9/16 inches from the center of the central base portion 54.

Additionally, in a presently preferred embodiment of the modular base side bearing assembly 60, the free height, $H'_f$ can be about 6 1/16 inches, will go solid at a height $H'_s$ of about 4 7/16 inches and the set up height $H'_{su}$ can be about 5 1/16 inches. The tolerances for $H'_s$ and $H'_{su}$ can be ±1/16 inch.

An embodiment of another, interchangeable, modular base 70 is illustrated in FIGS. 23 through 27, wherein the modular base 70 has a central opening 74 instead of a central base portion. The central opening 74 is shaped corresponding to the shape of the central bottom opening 34 in the cage 32, such that the bearing element 49 will be supported on the bolster, not by the modular base 70. This configuration provides an embodiment of a modular base side bearing assembly 80 (described in more detail hereinafter) having a minimum force level. In other respects, the modular base 70 can be like the modular bases 36 and 50, described previously, except that no upstanding boss is provided. Instead, upstanding side walls can be provided, which can form the central opening 74, and can surround the outside of the bearing element 49 to thereby center the bearing element in the cage 32. The side walls can also be receivable in the central opening 74. The shape of the central opening, and such upstanding side wall as may be provided, correspond to the shape of the central bottom opening 34 in the cage 32. Although a cylindrical bearing cavity is illustrated, other shapes, for example, rectangular, could be utilized, in which case the central bottom opening in the cage and the central opening in the modular base could also both be rectangular.

As explained above, the central opening 74 is corresponds with the central bottom opening 34 in the cage 32 such that the bearing element 49 will be supported on the mounting surface on which the cage 32 is attached. Accordingly, the "thickness" of the "central base portion" for the modular base 70 is "zero."

As shown, the modular base 70 similarly has outward extending tabs 71, 72, like the tabs on the previously described modular bases. The tabs 71, 72 likewise protrude through the openings 37 in the bottom surface at opposite sides of the cage 32 when the modular base 70 is assembled therewith. Upstanding clips 79 are likewise provided on the modular base 70 which cooperate with the travel limiting stop formed by the shelf 44 farmed by the central bottom opening 34 to retain the modular base 70 against the cage 32.

FIGS. 28 through 31 illustrate another embodiment of a modular side bearing assembly 80 having the same cage 32, bearing element 49 and wear cap 42 as used in the modular side bearing assemblies 30 and 60, described previously. The only difference in the modular side bearing assembly 80 is that the modular base 70, shown in FIGS. 23 through 27, is assembled with the cage 32, instead of modular base 36, or 50. The modular base 70 fits onto the bottom of the cage 32, with the sidewall of the central opening 74 received in the bottom central opening 34 in the cage 32. The upstanding clips 79 cooperate with the shelf 44 formed by the central bottom opening 34 to retain the modular base 70 against the cage 32.

In this embodiment, the bearing element 49 is not supported on the modular base 70, but rather is supported by the mounting surface on the bolster to which the cage 32 is attached. Thus, the bearing element 49 is supported within the cage 32 at the lowest free height relative to the mounting surface. This results in a minimum preload, and thus a minimum force level for the side bearing assembly 80. The central opening 74 in the modular base 70 can have an outside diameter ($D_2$) of about 4 3/16 inches, like the outer diameter of the central base portions 38 and 54 of the modular bases 36 and 50. In other respects, the modular base 70 can be identical to the modular bases 36 and 50, including the tabs 71, 72, having the same width ($w_2$) of about 3 9/16 inch and likewise extending radially outward the same distance ($l_2$) of about 3 9/16 inches from the center of the central opening 74. The thickness of the tab portions 71, 72 can also be the same as for the tab portions of the modular bases 36 and 50, such that tab portions 71, 72 similarly extend through the same sized openings 37 in the bottom of the cage 32. The tabs portions, 71, 72 likewise prominently display, in some manner, the force level of the side bearing assembly 80 which corresponds particularly to the modular base 70.

In a presently preferred embodiment of the modular base side bearing assembly 80, the free height, $H''_f$ can be about 5½ inches, will go solid at a height $H''_s$ of about 4⁷⁄₁₆ inches, and the set up height $H''_{su}$ can be about 5¹⁄₁₆ inches. The tolerances for $H_s''$ and $H_{su}''$ can be ±¹⁄₁₆ inch.

As can be understood from the preceding description, according to the invention a modular base side bearing assembly can be provided wherein each of the components of the side bearing assembly can be identical except for an interchangeable, modular base. The thickness of the modular base determines the force level of a given side bearing assembly, and thus side bearing assemblies which provide various different force levels can be provided wherein all of the parts of the assembly are standard except for the modular base. The modular bases can be made in different degrees of thickness, are interchangeable with other modular bases, and each can be assembled with the same standard components, e.g., cage, bearing element, and wear cap to provide side bearing assemblies having variable force levels. The modular base is further designed such that the specific force level of each modular side bearing assembly is plainly visible and easily readable even when the side bearing assembly is installed on the rail vehicle.

The modular base determines the force level of the side bearing assembly, and force level information is provided on the modular base itself. Thus, the force level for the side modular base bearing assembly is not associated with any of the other standard components of the assembly. In this way, there can be no situation in which the inadvertent selection of a wrong component could result in a modular base side bearing assembly having force characteristics different from that which is specifically indicated on the assembly itself.

According to another aspect of the invention, each of the modular bases are designed to be received in the bottom opening 34 in the cage 32 in a manner permitting some degree of vertical play. The assembly of each modular base with the cage 32 is designed to generally hold the modular base 36 to the cage 32 in the bottom opening 34 to prevent complete detachment therebetween, such as the modular base falling away from the cage 32. As shown in the drawing figures, this can be accomplished via the upstanding clips, as described previously. However, these clips do not prevent the modular base from moving vertically upwards relative to the cage 32.

Accordingly, the fit between the central base portion of each modular base and the bottom opening 34 in the cage 32 permits a sufficient degree of vertical displacement of the modular base 36 relative to the cage 32. In this way, the modular base will accommodate a non-flat mounting surface, for example a high spot, so that when the ears 54, 55 of the cage 32 are bolted to the mounting surface no stressing or deformation of the cage 32 will occur.

Annular grooves 43, 53 in the modular base members 36 and 50 can be provided for weight reduction, and also for manufacturing related reasons. In the modular base 70, the underside of the tab portion 71, 72 can be hollow. In regard to the manufacturing reasons, the modular bases can preferably be made by injection molding, such as from, for example, a nylon material. The annular grooves (or hollow tabs) can facilitate the production process because it can be more difficult to injection mold thick sections.

Various other features of the modular base member 36, 50 and 70 are illustrated in the drawing figures, for example, the particular shape of the identification portions and certain presently preferred dimensions. Similarly, the cage 32 is also shown having various features and certain presently preferred dimensions in the various drawing figures. Such information should be understood generally as being associated with certain preferred embodiments of the invention and should not be interpreted as limiting to the invention.

Accordingly, although certain embodiments of the invention have been described in detail, it would appreciated by those skilled in the art that various modifications of those details could be developed in light of the overall teaching of the disclosure. Therefore, the particular embodiments disclosed herein are intended to be illustrative only and not limiting to the scope of the invention.

What is claimed is:

1. A modular base and cage for a rail vehicle side bearing assembly, the modular base and cage comprising:

a. a bearing element supporting a weight of a rail car and providing a force level to the rail car for resistance of rail car swivel;

b. a cage having upstanding side walls, said cage defining a bearing cavity for receiving said bearing element, said cage having an open bottom; and c. a modular base receivable in said open bottom of said cage, said modular base forming the bottom surface of said bearing cavity for supporting said bearing element.

2. The modular base and cage of claim 1 further comprising said modular base being vertically movable relative to said cage.

3. The modular base and cage of claim 1 further comprising said modular base having at least one identification portion externally visible of said cage when said modular base is assembled with said cage.

4. The modular base and cage of claim 3 further comprising said at least one identification portion exhibiting an indicator of a force level of said bearing element.

5. The modular base and cage of claim 4 wherein said indicator at least one of identifying text, notches, and colors.

6. The modular base and cage of claim 1 further comprising said modular base being captured within said cage when said cage and modular base are attached to said rail vehicle.

7. The modular base and cage of claim 1 further comprising:

a. at least one tab opening in a bottom portion of said cage; and b. said at least one identification portion extending from said modular base through said at least one tab opening such that said at least one identification portion is externally visible when said modular base is assembled with said cage.

8. The modular base and cage of claim 7 further comprising:

a. said at least one tab opening being a pair of tab openings; and b. said at least one identification portion being a pair of identification portions, and said pair identification portions projecting through said pair of tab openings.

9. The modular base and cage of claim 8 further comprising:

a. at least one upstanding clip projecting from said modular base; and b. said upstanding side walls defining a shelf which cooperates with said at least one upstanding clip to prevent said modular base from inadvertently dislodging from said open bottom.

10. The modular base and cage of claim 9 further comprising said shelf defining a travel limiting stop for a wear cap.

11. The modular base and cage of claim 7 further comprising said at least one identification portion exhibiting an indicator of a force level of said bearing element.

12. The modular base and cage of claim 11 wherein said indicator further comprises at least one of identifying text, notches, and colors.

13. The modular base and cage of claim 1 wherein said modular base has a thickness, said thickness corresponding to said force level of said bearing element when said modular base is assembled with said cage and said bearing element is disposed in said bearing cavity.

14. The modular base and cage of claim 13 further comprising an upstanding boss centrally positioned on said modular base, said boss being receivable in a hole defined in said bearing element, such that said boss will centrally locate said bearing element in said bearing cavity.

15. The modular base and cage of claim 1 wherein said modular base defines a plurality of annular grooves in an underside thereof.

16. The modular base and cage of claim 1 further comprising:

a. a wear cap disposed over said bearing element.

17. A modular base and cage for a rail vehicle side bearing assembly, the modular base and cage comprising:

a. a cage having upstanding side walls, said cage defining a bearing cavity for receiving a bearing element, said cage having an open bottom; and b. a modular base receivable in said open bottom of said cage, said modular base forming the bottom surface of said bearing cavity for supporting said bearing element, wherein said central opening in said modular base defines side walls, said side walls centrally locating said bearing element when disposed in said bearing cavity.

18. A rail vehicle side bearing assembly comprising:

a. a bearing element supporting a weight of a rail car and providing a force level to the rail car for resistance of rail car swivel;

b. a cage having upstanding side walls, said cage defining a bearing cavity for receiving said bearing element, said cage having an open bottom;

c. a modular base receivable in said open bottom of said cage, said modular base being a separate element from said cage and defining a bottom surface of said bearing cavity for supporting said bearing element.

19. The side bearing assembly of claim 18 further comprising said modular base being vertically movable relative to said cage.

20. The side bearing assembly of claim 18 wherein said modular base has at least one identification portion externally visible of said cage when said modular base is assembled with said cage.

21. The side bearing assembly of claim 20 further comprising said at least one identification portion exhibiting an indicator of a force level of said bearing element.

22. The side bearing assembly of claim 21 wherein said indicator comprises at least one of identifying text, notches, and colors.

23. The side bearing assembly of claim 20 further comprising:

a. at least one tab opening in a bottom portion of said cage; and b. said at least one identification portion extending from said modular base through said at least one tab opening such that said at least one identification portion is externally visible when said modular base is assembled with said cage.

24. The side bearing assembly of claim 23 further comprising:

a. said at least one tab opening being a pair of tab openings; and b. said at least one identification portion being a pair of identification portions, and said pair identification portions projecting through said pair of tab openings.

25. The side bearing assembly of claim 24 further comprising:

a. at least one upstanding clip projecting from said modular base; and b. said open bottom defining a shelf which cooperates with said at least one upstanding clip to prevent said modular base from inadvertently dislodging from said open bottom.

26. The side bearing assembly of claim 25 wherein said shelf defines a travel limiting stop for a wear cap.

27. The side bearing assembly of claim 23 wherein said at least one identification portion exhibits an indicator of a force level of said bearing element.

28. The side bearing assembly of claim 27 wherein said indicator further comprises at least one of identifying text, notches, and colors.

29. The side bearing assembly of claim 18 wherein said modular base is captured against said cage when said cage is attached to said rail vehicle.

30. The side bearing assembly of claim 18 wherein said modular base has a thickness, said thickness corresponding to said force level of said bearing element when said modular base is assembled with said cage and said bearing element is disposed in said bearing cavity.

31. The side bearing assembly of claim 30 further comprising an upstanding boss centrally positioned on said modular base, said boss being receivable in a hole defined in a bearing element, such that said boss will centrally locate said bearing element in said bearing cavity.

32. The side bearing assembly of claim 18 wherein said modular base defines a plurality of annular grooves in an underside thereof.

33. The side bearing assembly of claim 18 further comprising a wear cap disposed over said bearing element.

34. A rail vehicle side bearing assembly comprising:

a. a cage having upstanding side walls, said cage defining a bearing cavity for receiving a bearing element, said cage having an open bottom;

b. a modular base receivable in said open bottom, said modular base defining a bottom surface of said bearing cavity for supporting said bearing element; and c. a bearing element disposed in said bearing cavity, wherein said opening in said modular base defines side walls, said side walls centrally locating said bearing element when disposed in said bearing cavity.

* * * * *